US005079528A

United States Patent [19]

Yorita et al.

[11] Patent Number: 5,079,528

[45] Date of Patent: Jan. 7, 1992

[54] DIELECTRIC FILTER

[75] Inventors: Tadahiro Yorita; Yasuo Yamada, both of Nagaokakyo, Japan

[73] Assignee: Murata Manufacturing Co. Ltd., Japan

[21] Appl. No.: 541,625

[22] Filed: Jun. 21, 1990

[30] Foreign Application Priority Data

Jun. 21, 1989 [JP] Japan ..... 1-159238
Jun. 22, 1989 [JP] Japan ..... 1-160542

[51] Int. Cl.[5] ..... H01P 1/202
[52] U.S. Cl. ..... 333/206; 333/202
[58] Field of Search ..... 333/202, 204, 206, 207, 333/222, 223, 219, 219.1, 245

[56] References Cited

U.S. PATENT DOCUMENTS 4,276,525 6/1981 Nishikawa et al. ..... 333/206
4,546,334 10/1985 Nishikawa et al. ..... 333/206
4,703,291 10/1987 Nishikawa et al. ..... 333/202

FOREIGN PATENT DOCUMENTS 0005525 11/1979 European Pat. Off. .
0312011 4/1989 European Pat. Off. ..... 333/202
0179603 8/1986 Japan ..... 333/222
0191101 8/1986 Japan ..... 333/206
0193501 8/1986 Japan ..... 333/206
0237501 10/1986 Japan ..... 333/202
0117401 5/1987 Japan ..... 333/206
1485505 9/1977 United Kingdom .
2174849 11/1986 United Kingdom .

*Primary Examiner*—Eugene R. LaRoche
*Assistant Examiner*—Seung Ham
*Attorney, Agent, or Firm*—Ostrolenk, Faber, Gerb & Soffen

[57] ABSTRACT

A dielectric filter which includes a plurality of dielectric resonators, and a plurality of coupling capacitors connected in series to each other, at least one portion of respective portions between the neighboring coupling capacitors being grounded through a series circuit of a series resonance capacitor and the corresponding one of the dielectric resonators, and other portions of the respective portions between them being grounded through other dielectric resonators. The coupling capacitors are each formed between electrodes formed on a substrate, and the series resonance capacitor is formed to confront the electrodes constituting the coupling capacitors.

8 Claims, 7 Drawing Sheets

Fig. 2(a)
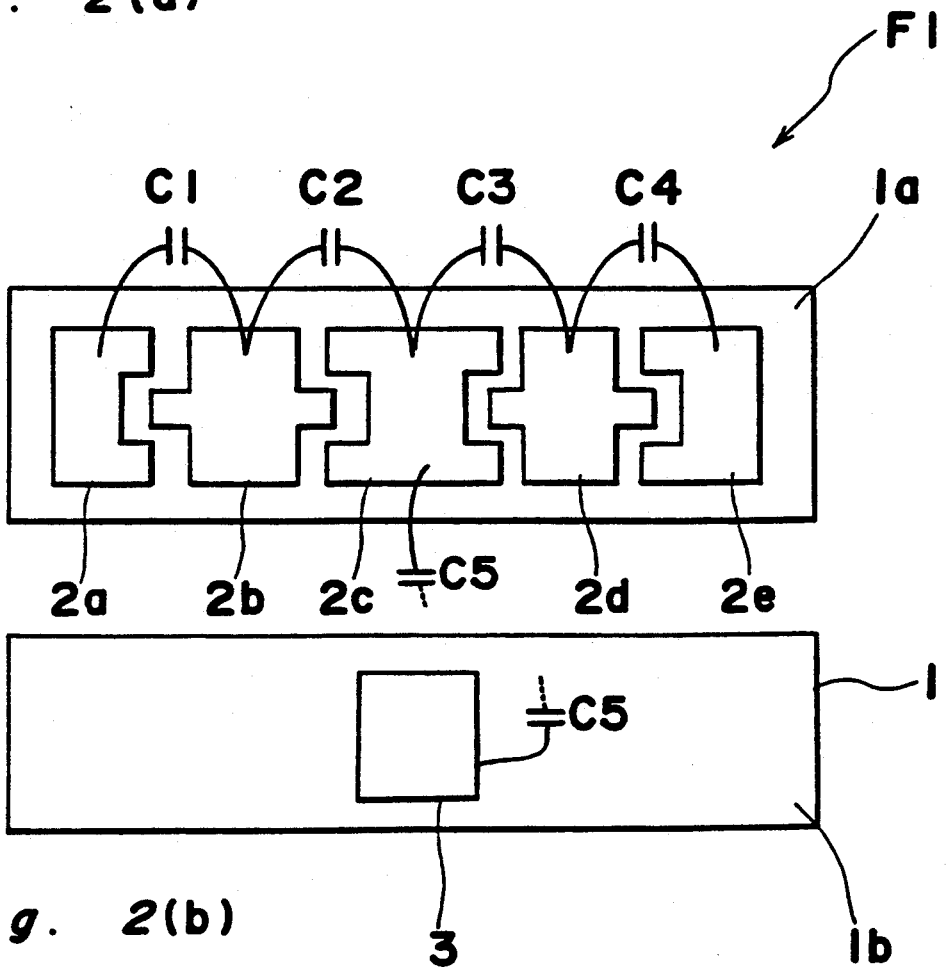
Fig. 2(b)
Fig. 3
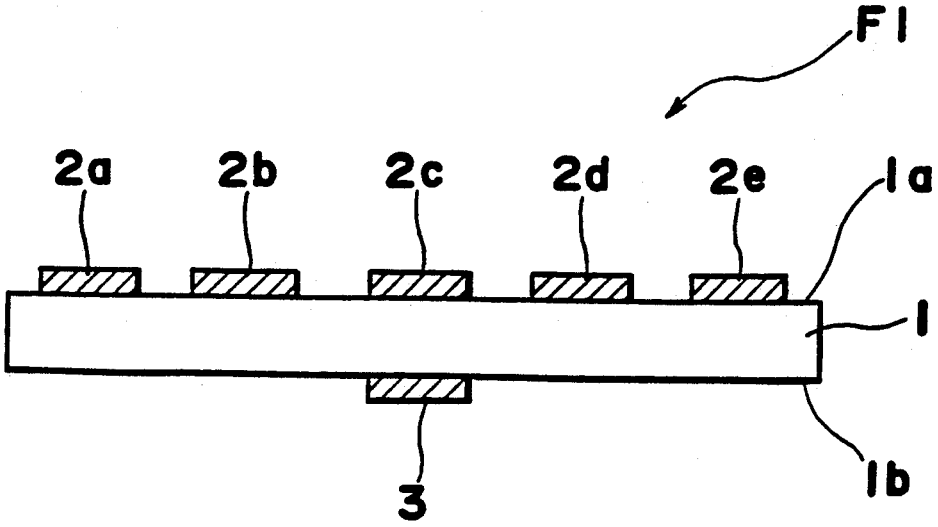

DIELECTRIC FILTER

BACKGROUND OF THE INVENTION

The present invention generally relates to an electrical filter, and more particularly, to a dielectric filter in which a plurality of dielectric resonators are coupled by capacitance so as to obtain required band-pass characteristics.

A band-pass filter as referred to above, for example, having a three stage structure, has an equivalent circuit as shown in FIG. 6, and includes a series resonance capacitor C5 connected in series to one of three dielectric resonators 11 connected to ground, and four coupling capacitors C1,C2,C3 and C4 in total, with the junction between each two of said coupling capacitors being respectively connected to one of said dielectric resonators 11 as shown.

FIG. 10 shows a structure of a conventional dielectric filter based on the equivalent circuit of FIG. 6. In the filter of FIG. 10, the coupling capacitors Cl to C4 are formed respectively between five electrodes Ea,Eb,Ec,Ed and Ee formed on the upper surface of a substrate S. Terminal pin P serves as a series resonance capacitor and also is attached (as described below) to an inner conductor Rb of one of the dielectric resonators R. The terminal Pin P is connected at its end Pa, to the central electrode Ec, while terminals T attached to inner conductors Rb of the other dielectric resonators R are respectively connected, at lug portions Ta thereof, to the corresponding neighboring electrodes Eb and Ed. As shown in FIG. 11, each of the terminals T has a base end to be attached to the inner conductor Rb, formed generally into a cylindrical shape, and a forward end thereof formed into a lug portion Ta for connection with the corresponding electrode. Although not particularly shown, terminals for input and output are connected to the electrodes Ea and Ee at the opposite ends of the substrate S for external connections.

As illustrated in FIG. 12, the terminal pin P of a metallic material has its one end Pb inserted into an attaching jig J of a resin material, which is further fitted into the inner conductor Rb of the dielectric resonator R, with its other end Ra projecting outwardly from the jig J of the dielectric material, thereby to form the series resonance capacitor C5 between the end portion Pb and the inner conductor Rb of the dielectric resonator R. The capacitor C5 referred to above functions to sharpen the characteristic at the end of the pass-band region by forming an attenuation pole as shown at A in FIG. 13 by a solid line curve, the normal state being represented by a dotted line, i.e. by polarization as shown in FIG. 13.

However, when the capacitance of the series resonance capacitor C5 is provided by a terminal pin P as described above, there has been the disadvantage that, since the attaching jig J of the resin material is disposed between the metallic pin portion Ra and the inner conductor Rb, the capacitance tends to vary to a large extent depending on temperature, thus resulting in statistical scattering of the frequency characteristics.

In order to overcome the disadvantage as described above, there has also been conventionally proposed an arrangement as shown in FIG. 14, in which another electrode Ef is formed on the substrate S in a position close to the central electrode Ec, which forms part of the coupling capacitors. The series resonance capacitor C5 for polarization is thereby formed between said electrodes Ec' and Ef, and the lug portion Ta of the terminal T attached to the inner conductor Rb of the dielectric resonator R is connected to the electrode Ef. However, in the above case, the problem has been that a large capacitance is not available due to the small area of the electrode Ef, and it would be required to enlarge the substrate in order to obtain a large capacitance by increasing the electrode area, thus undesirably resulting in a large overall size of the filter.

SUMMARY OF THE INVENTION

Accordingly, an essential object of the present invention is to provide a dielectric filter which is compact in size and stable in frequency characteristics, with substantial elimination of the disadvantages inherent in the conventional dielectric filters of this kind.

Another object of the present invention is to provide a dielectric filter of the above described type which is simple in construction, and can be readily manufactured on a large scale at low cost.

In accomplishing these and other objects, according to one aspect of the present invention, there is provided a dielectric filter which includes a plurality of dielectric resonators, and a plurality of coupling capacitors which are formed by pairs of electrode portions and are connected in series to each other, with at least one electrode portion between a pair of said neighboring coupling capacitors being grounded through a series circuit of a series resonance capacitor and the corresponding one of the dielectric resonators, and other electrode portions being grounded through other dielectric resonators. The coupling capacitors are each formed between electrodes formed on a substrate, and said series resonance capacitor is formed by an electrode which confronts the electrodes constituting said coupling capacitors.

In the above arrangement of the present invention, since the series resonance capacitor is constituted by the confronting electrode formed on the substrate, the capacitance of the capacitor does not depend on the temperature thereof, and the capacitance can be a larger than in the case where the electrodes are formed adjacent to each other as in the conventional filter, thus making it possible to employ a substrate of a small size.

In another aspect of the present invention, there is provided a dielectric filter which also includes a plurality of dielectric resonators and a plurality of coupling capacitors connected in series to each other, with at least one portion of portions between said neighboring coupling capacitors being grounded through a series circuit of a series resonance capacitor and the corresponding one of the dielectric resonators, and other portions of said portions therebetween being grounded through other dielectric resonators. The coupling capacitors are each formed between electrodes formed on a first substrate, and the series resonance capacitor is constituted by confronting electrodes formed on opposite faces of a second substrate. The second substrate is mounted on said first substrate in a state where the electrode at one side of said second substrate is connected a corresponding one of the coupling capacitor electrodes formed on said first substrate.

By the other arrangement of the present invention as described above, since the series resonance capacitor is constituted by the confronting electrodes formed on the second substrate, the capacitance of the capacitor is less dependent on temperatures than in the case where the conventional terminal pin P is employed, while owing to the construction in which the series resonance capacitor is formed by the non-adjacent electrodes, which confront each other, mounted on the surface of the first substrate, a large capacitance may be obtained in spite of the small size. Moreover, by the above structure, a smaller substrate may be employed for first substrate.

BRIEF DESCRIPTION OF THE DRAWINGS

These and other objects and features of the present invention will become apparent from the following description of several preferred embodiments thereof with reference to the accompanying drawings, in which;

FIG. 3 is a front elevational view of the substrate shown in FIGS. 2.

DETAILED DESCRIPTION OF THE INVENTION

Figure 1:
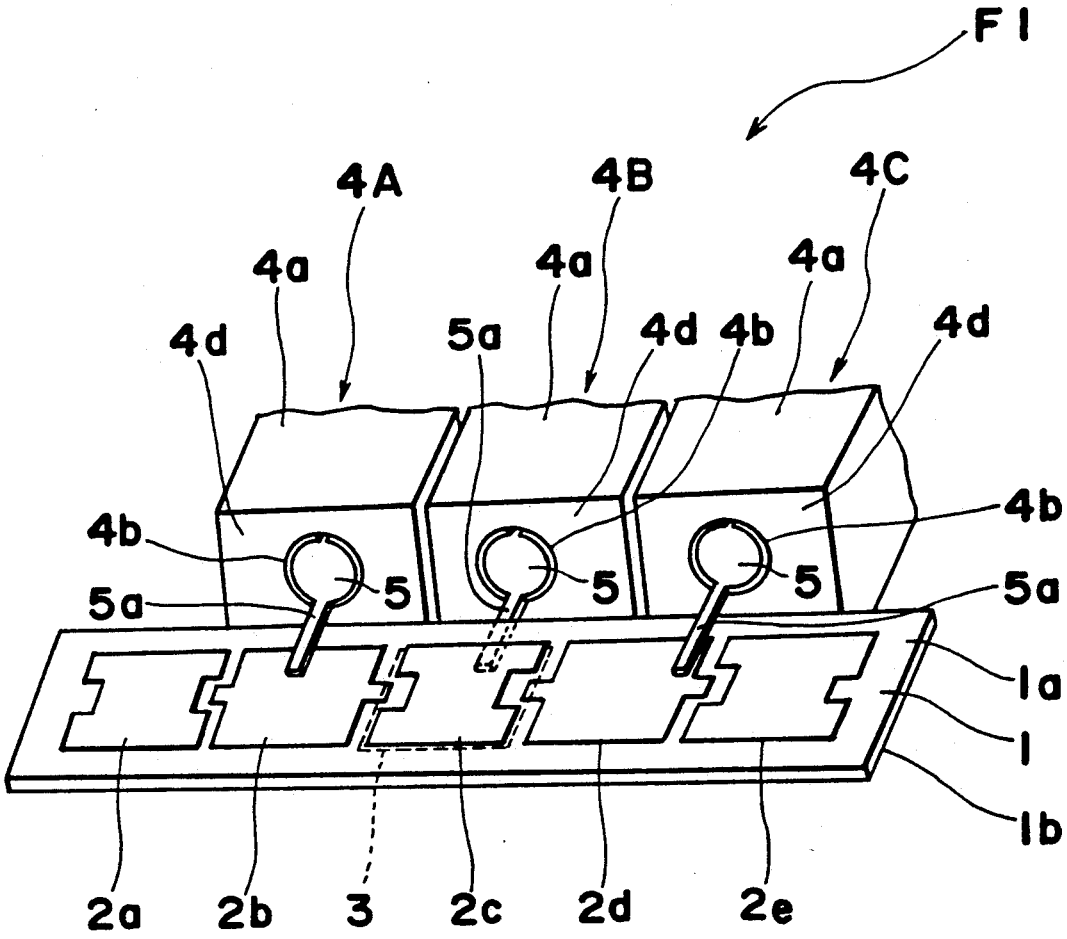
FIG. 1 is a fragmentary perspective view showing a dielectric filter according to one preferred embodiment of the present invention, FIGS. 2(*a*) and 2(*b*) are respectively top plan and bottom plan views of a substrate employed in the dielectric filter of FIG. 1.

Before the description of the present invention proceeds, it is to be noted that like parts are designated by like reference numerals throughout the accompanying drawings.

Referring now to the drawings, there is shown in FIGS. 1 to 3, a dielectric filter Fl according to one preferred embodiment of the present invention, which generally includes a plurality of dielectric resonators, e.g. three dielectric resonators 4A, 4B and 4C, each constituted by a dielectric member 4*d* having an inner conductor 4*b* and an outer conductor 4*a*, and a base plate or substrate 1 of a dielectric material or the like formed, on its upper surface 1*a*, with five electrodes 2*a*,2*b*,2*c*,2*d* and 2*e*, with coupling capacitors C1,C2,C3 and C4 being formed respectively between said electrodes. On the reverse surface 1*b* of the substrate 1 corresponding in position to the central electrode 2*c* on the upper surface thereof, there is formed another electrode 3, and the confronting electrode formed by said electrode 3 and the central electrode 2*c* constitutes a series resonance circuit C5, since the substrate 1 is made of the dielectric material or the like and is disposed therebetween (FIG. 2).

To the electrodes 3 of the confronting electrodes located on the reverse surface of the substrate 1, there is connected a lug portion 5*a* of a terminal 5 attached to the inner conductor 4*b* of the dielectric resonator 4B whose outer conductor 4*a* is grounded. Similarly, other terminals 5, each having a similar shape, are attached to the inner conductors 4*b* of the dielectric resonators 4A and 4C whose outer conductors 4*a* are grounded, and are respectively connected, at the lug portions 5*a* thereof, to the corresponding electrodes 2*b* and 2*d* on the surface of the substrate opposite to that of the electrode 3.

It should be noted that, although the present invention is described so far with reference to the dielectric filter composed of three stages, the concept of the present invention is not limited in its application to the dielectric filter of three stages alone, but may be readily applied to dielectric filters of two or more than three stages as well.

Figure 4:
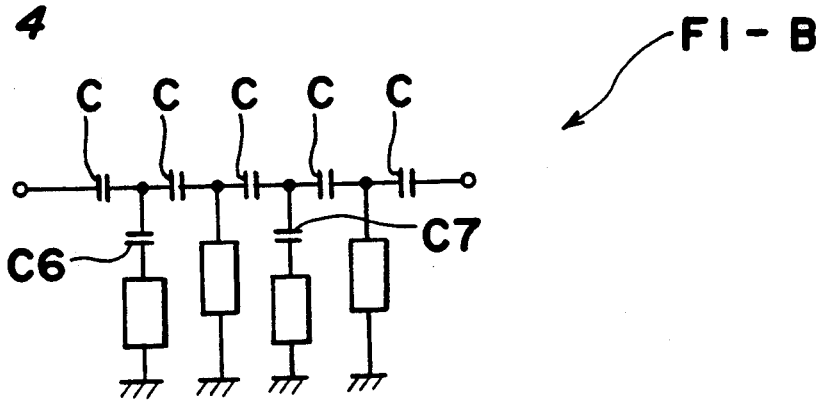
FIG. 4 is an equivalent circuit diagram showing a modification of the dielectric filter of FIG. 1, in which two series resonant capacitors are employed.

In the foregoing embodiment, the present invention is applied to the dielectric filter in which the series resonance capacitor is provided in series with the dielectric resonator only at one place, but the concept of the present invention is not limited to the above, and it may also be applied to a dielectric filter in which series resonance capacitors C6 and C7 are provided at two positions as shown in FIG. 4, or to a dielectric filter provided with series resonance capacitors at more than two places (not particularly shown).

Figure 5:
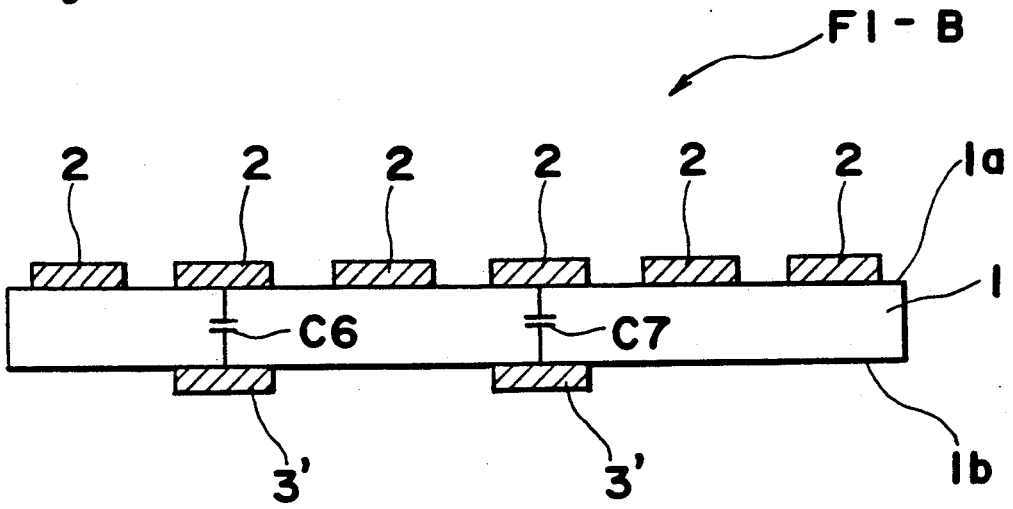
FIG. 5 is a side elevational view of a substrate for the modified dielectric filter adopting the circuit construction as shown in FIG. 4.

Regarding the construction in the above cases, description will be given, by way of example, with reference to the dielectric filter in which the series resonance capacitors are provided at two places as shown in FIG. 5. In the arrangement of FIG. 5, six electrodes 2 are formed on the surface 1*a* of the substrate 1 for constituting the coupling capacitors, while two electrodes 3' are formed on the reverse surface 1*b* of the substrate 1 so as to confront the corresponding two of the electrodes 2, whereby the series resonance capacitors C6 and C7 are constituted between the confronting electrodes 2 and 3'.

It is to be further noted that, in the foregoing embodiment, although the dielectric resonators divided unit by unit are employed, they are not limited to such type, but a dielectric resonator in which a plurality of inner conductors are provided in one block may also be employed for the purpose depending on necessity.

As is seen from the foregoing description, in the dielectric filter according to the first embodiment of the present invention, since the series resonance capacitor is constituted by the confronting electrodes formed on the substrate, variation in the capacitance capacity due to temperature may be suppressed for stabilization of frequency characteristics, while a larger capacitance is available than in the case where neighboring electrodes are formed on one side face of the substrate. Moreover, owing to the construction in which the electrodes are formed on the opposite surfaces of the substrate, said substrate may be reduced in its size to provide a overall compact size of the filter and consequently, a reduction in cost.

In addition to the above, superior productivity may be achieved, since all the capacitors can be formed on one substrate, and further, owing to the arrangement that the coupling circuits can be dealt with as one block, good workability may also be obtained.

Figure 7:
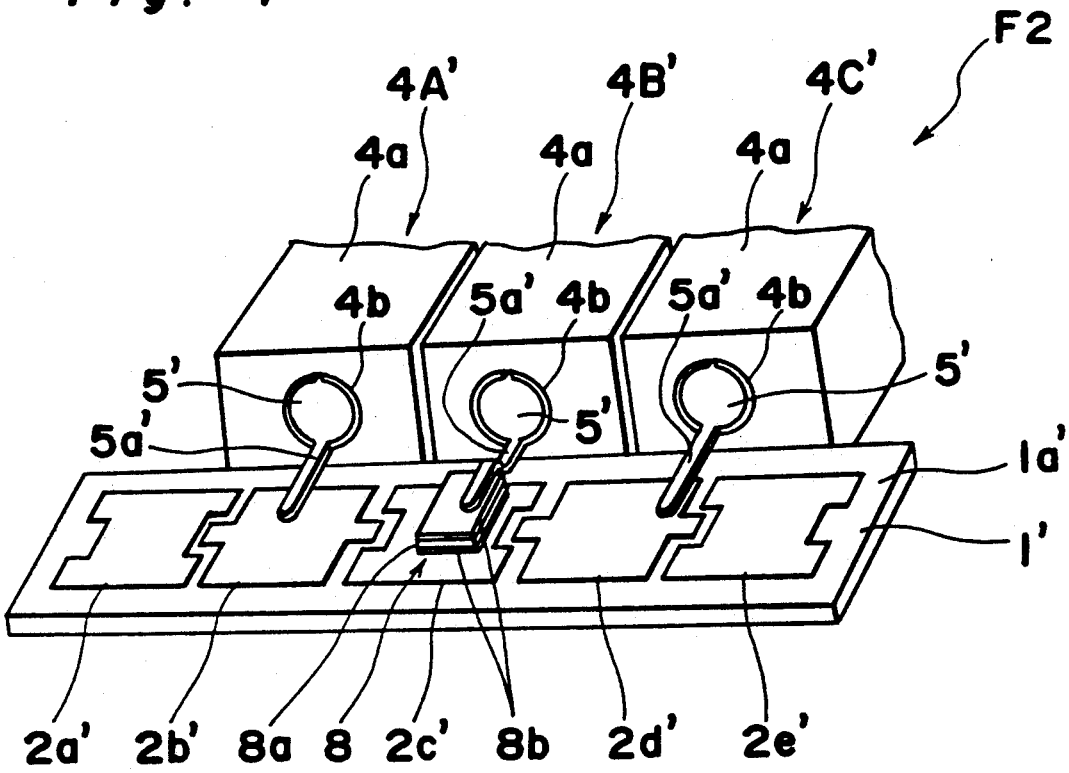
FIG. 7 is a fragmentary perspective view showing a dielectric filter according to a second embodiment of the present invention.
Figure 8:
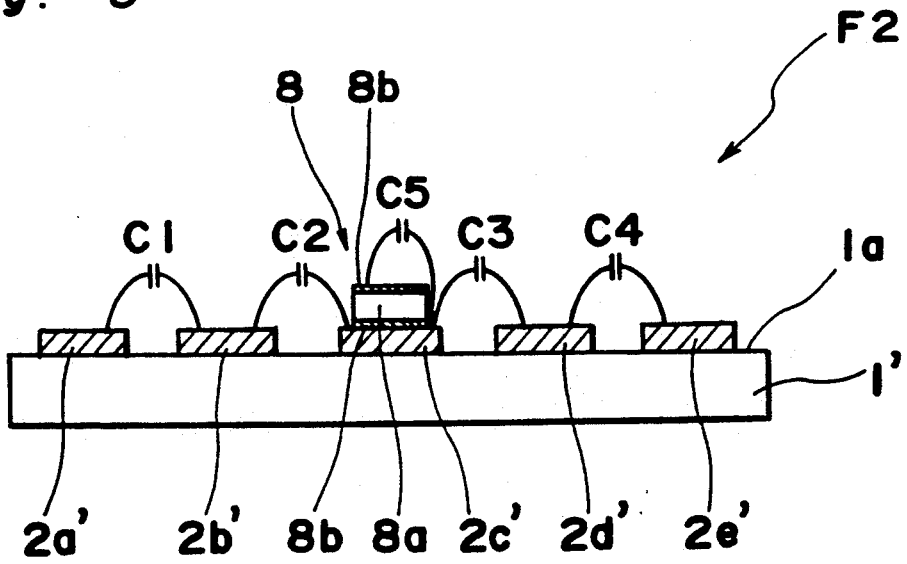
FIG. 8 is a front elevational view of a substrate employed in the dielectric filter of FIG. 7.

Referring further to FIGS. 7 and 8, there is shown another dielectric filter F2 according to a second embodiment of the present invention. The dielectric filter F2 also includes, e.g. three dielectric resonators 4A',4B' and 4C' having similar constructions to the dielectric resonators 4A to 4C in FIG. 1, with like parts being designated by like reference numerals, and five electrodes 2a',2b',2c',2d' and 2e' formed on a surface 1a' of a substrate 1', whereby coupling capacitors C1,C2,C3 and C4 are formed between respective electrodes as in the arrangement of FIGS. 1 to 3. It is to be noted here that in the above dielectric filter F2, although opposite edges (left and right edges in FIG. 7) of the respective electrodes are alternately formed into concave and convex shapes for increasing the capacity, they may be formed straight depending on necessity.

On the central electrode 2c', there is mounted a plate-like capacitor chip 8, which further includes a small sized second substrate 8a, and confronting electrodes 8b formed on opposite faces of said substrate 8a, thereby to form a capacitor therebetween. One of the electrodes 8b, e.g. the electrode 8b on the lower face is connected to the central electrode 2c, so as to form the series resonance capacitor C5 as a circuit. For the above connection between one confronting electrode 8b and the central electrode 2c, reflow soldering or the like, silver baking, bonding by an electrically conductive bonding agent, etc. may be adopted.

Figure 11:
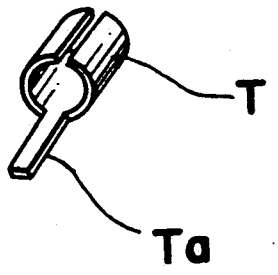
FIG. 11 is a perspective view of a terminal employed in the dielectric filter of FIG. 10 (already referred to)
Figure 12:
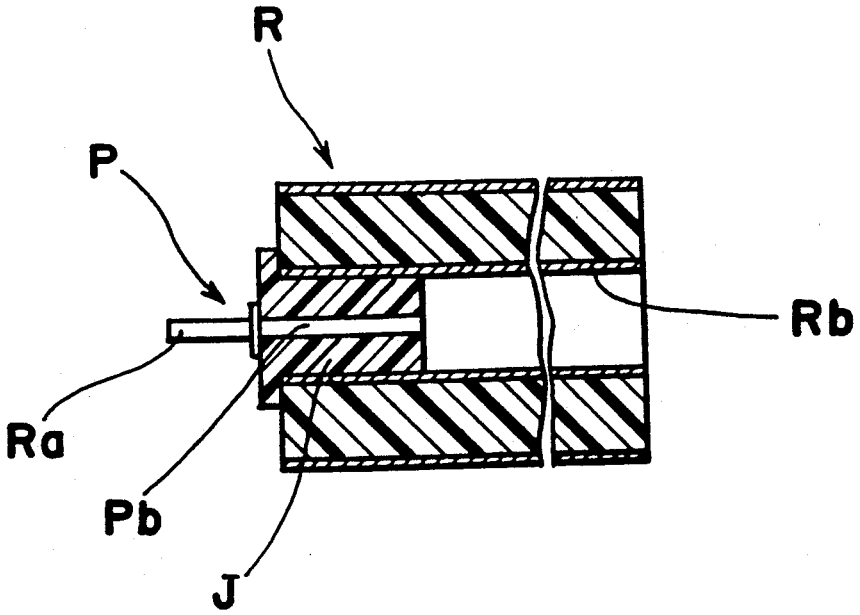
Fig. 12 PRIOR ART
FIG. 12 is a cross sectional view of a dielectric resonator and a terminal pin fitted therein as employed in the conventional dielectric filter of FIG. 10 (already referred to)
Figure 13:
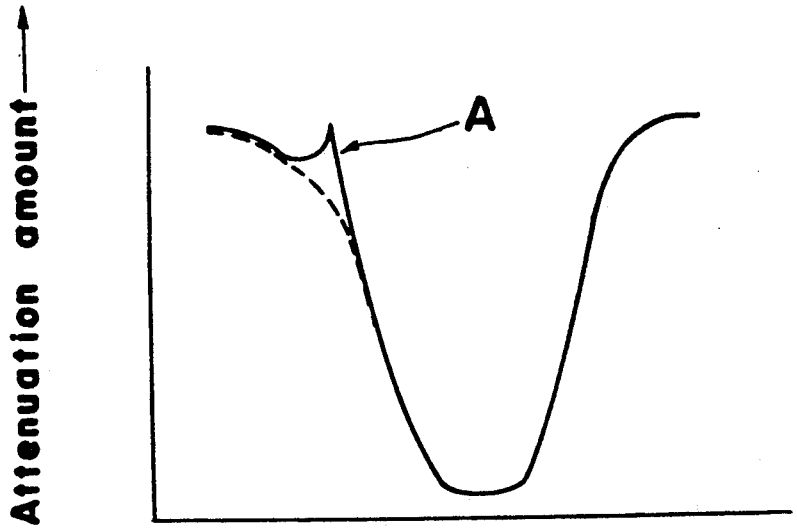
FIG. 13 is a graphical diagram for explaining the state of polarization in the band pass characteristic (already referred to)
Figure 14:
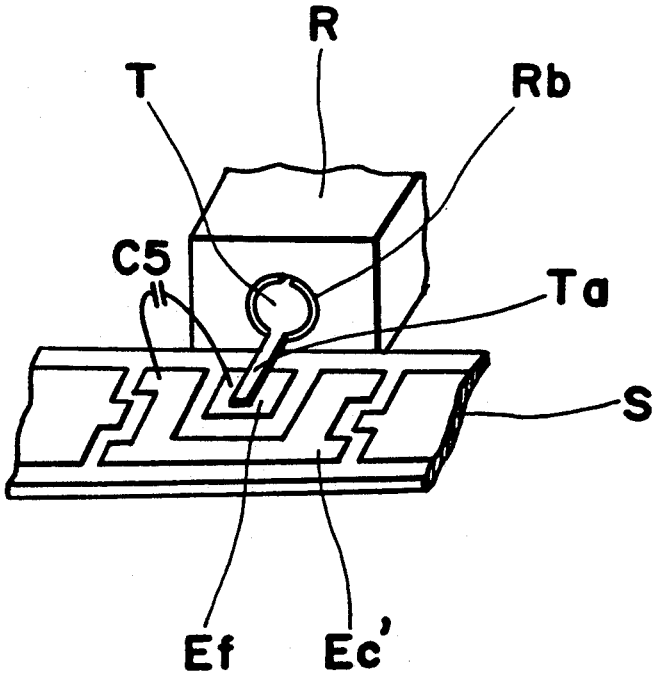
Fig. 14 PRIOR ART
FIG. 14 is a fragmentary perspective view showing an arrangement in another conventional dielectric resonator (already referred to).

To the upper confronting electrode 8b of the capacitor chip 8, and the electrodes 2b, and 2d' neighboring the central electrode 2c, to which the lower confronting electrode 8b is connected, the lug portions 5a, of the terminals 5' (each attached to the inner conductors 4b of the resonators 4A',4B' and 4C' whose outer conductors are grounded), are connected as shown. Each of said terminals 5' has a similar shape to that of the terminal T referred to earlier with reference to FIG. 11.

Figure 6:
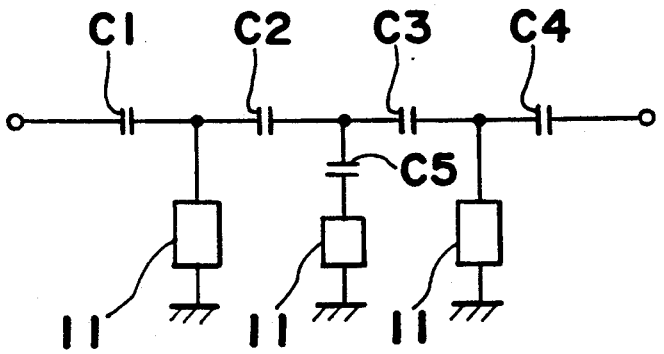
FIG. 6 is an equivalent circuit diagram showing of a dielectric filter in three stages (already referred to)

The dielectric filter of the present embodiment having the construction as described so far may be represented by the equivalent circuit shown in FIG. 6.

It should be noted here that, the capacitor chip 8 need not necessarily be mounted on the central electrode 2c' as in the above embodiment, but may be provided on the electrode 2b' or 2d' to which the dielectric resonator 4A' or 4C' is connected. In the above case also, polarization as described earlier can be effected. It should also be noted that the present invention is not limited in its application to the dielectric filter of three stages as described so far alone, but may be readily applied to dielectric filters of two stages or more than three stages as well.

It should further be noted here that, in the foregoing second embodiment, the present invention is applied to the dielectric filter in which the series resonance capacitor is provided in series with the dielectric resonator only at one place, but the concept of the present invention is not limited to the above, but it may also be applied to a dielectric filter in which series resonance capacitors C6 and C7 are provided at two positions as shown in FIG. 4, or to dielectric filters provided with series resonance capacitors at more than two places.

Figure 9:
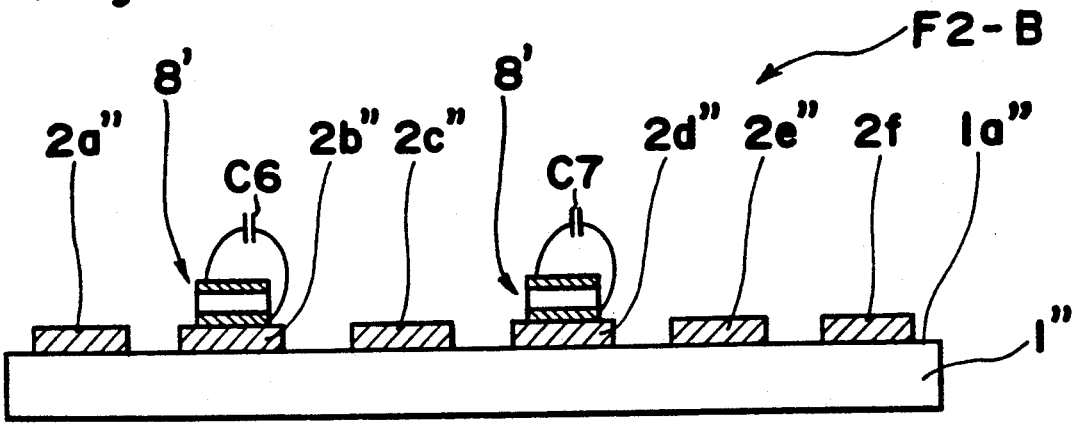
FIG. 9 is a view similar to FIG. 8, which particularly shows another modification thereof as related to the equivalent circuit of FIG. 4.
Figure 10:
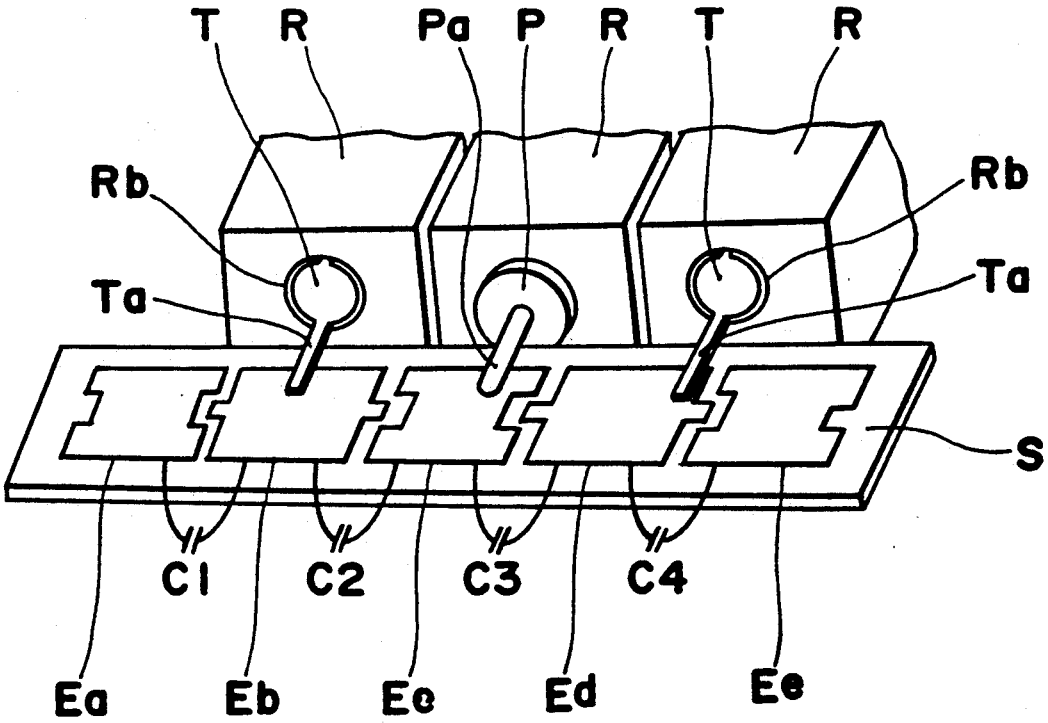
Fig. 10 PRIOR ART
FIG. 10 is a fragmentary perspective view showing the construction of a conventional dielectric filter (already referred to)

With respect to the construction in the above cases, description will be given, by way of example, with reference to the dielectric filter in which the series resonance capacitors are provided at two places as shown in FIG. 9. In the arrangement of FIG. 9, six electrodes 2a'',2b'',2c'',2d'',2e'' and 2f are formed on the surface 1a'' of the substrate 1'' for constituting the coupling capacitors, while two capacitor chips 8' are formed on the corresponding two electrodes 2b'' and 2d'', and thus, the state in which the series resonance capacitors C6 and C7 are connected between the electrodes constituting the coupling capacitors is established.

It is to be further noted that, in the foregoing embodiment, although dielectric resonators divided unit by unit are employed, they are not limited to such type, but a dielectric resonator in which a plurality of inner conductors are provided in one block may also be employed for the purpose depending on necessity.

As is seen from the foregoing description, in the dielectric filter according to the second embodiment of the present invention, since the series resonance capacitor is constituted by the confronting electrodes formed on the second substrate, variation in the capacitance due to temperature may be suppressed for stabilization of frequency characteristics, while a larger capacitance is available, since the series connection capacitor is constituted by electrodes which are not adjacent to each other as in the conventional arrangements, but rather confront each other through the substrate. Moreover, since a small-sized substrate may be used for the first substrate, compact size can be achieved, with simultaneous reduction in cost. In addition, owing to the construction in which the coupling circuit may be dealt with as one block, workability can be improved for efficient processing in the manufacture.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A dielectric filter which comprises:

a plurality of dielectric resonators, and a plurality of coupling capacitors connected in series with each other, each junction between a neighboring pair of coupling capacitors being associated with a corresponding one of said dielectric resonators, at least one of said junctions being grounded through a series circuit of a series resonance capacitor and the corresponding one of the dielectric resonators, and the other junctions being grounded through the other dielectric resonators, said coupling capacitors being each formed between electrodes formed on one side of a substrate, and said series resonance capacitor being formed by one of said electrodes constituting said coupling capacitors, and by a confronting electrode which confronts said one electrode on the opposite side of said substrate.

2. A dielectric filter as claimed in claim 1, wherein a second function between a second pair of said neighboring coupling capacitors is grounded through another series circuit of a series resonance capacitor and the one of the dielectric resonators corresponding to said second junction.

3. A dielectric filter as claimed in claim 1, wherein the plurality of the dielectric resonators include separator dielectric resonators each having a dielectric member provided with an outer conductor and an inner conductor coupled with said electrode formed on said substrate.

4. A dielectric filter as claimed in claim 1, wherein the plurality of the dielectric resonators is formed by one dielectric block provided with an outer conductor and a required number of inner conductors coupled with said electrodes formed on said substrate.

5. A dielectric filter which comprises:

a plurality of dielectric resonators, and a plurality of coupling capacitors connected in series with each other, each junction between a neighboring pair of coupling capacitors being associated with a corresponding one of said dielectric resonators, at least one of said junctions being grounded through a series circuit of a series resonance capacitor and the corresponding one of the dielectric resonators, and the other junctions being grounded through the other dielectric resonators, said coupling capacitors being each formed between electrodes formed on one side of a first substrate, and said series resonance capacitor being constituted by confronting electrodes formed on opposite faces of a second substrate, said second substrate being mounted on said first substrate with one said electrode on one side of said second substrate being connected with a corresponding one of said coupling capacitor electrodes formed on said first substrate.

6. A dielectric filter as claimed in claim 5, wherein a second junction between a second pair of said neighboring coupling capacitors is grounded through another series circuit of a series resonance capacitor and the one of the dielectric resonators corresponding to said second junction.

7. A dielectric filter as claimed in claim 5, wherein the plurality of the dielectric resonators include separate dielectric resonators each having a dielectric member provided with an outer conductor, and provided with an inner conductor coupled with one of said above-mentioned electrodes.

8. A dielectric filter as claimed in claim 5, wherein the plurality of the dielectric resonators is formed by one dielectric block provided with an outer conductor and a required number of lines conductors coupled with said above-mentioned electrodes.

* * * * *